US005142479A

United States Patent [19]

Poirier et al.

[11] Patent Number: 5,142,479

[45] Date of Patent: Aug. 25, 1992

[54] METHOD OF PREVENTING SPARK PLUG FOULING

[75] Inventors: David C. Poirier, Troy; Peter M. Medich, Birmingham; Robert C. Cameron, Novi; Patrick J. Westphal, Canton; Robert C. Simon, Jr., Novi, all of Mich.

[73] Assignee: General Motors Corporation, Detroit, Mich.

[21] Appl. No.: 549,171

[22] Filed: Jul. 6, 1990

[51] Int. Cl.[5] ..... F02D 41/30

[52] U.S. Cl. ..... 364/431.1; 123/491; 123/179 G; 123/179 L; 123/179.16; 123/179.17; 123/179.18

[58] Field of Search ..... 364/431.1; 123/491, 123/464, 179 G, 179 L

[56] References Cited

U.S. PATENT DOCUMENTS 4,245,317 1/1981 Marchak ..... 123/491
4,558,673 12/1985 Mackie ..... 364/431.1
4,582,036 4/1986 Kiuchi et al. ..... 123/179 G
4,739,741 4/1988 Iwata et al. ..... 123/491
4,838,230 6/1989 Matsuoka ..... 123/491

FOREIGN PATENT DOCUMENTS 57-46031 3/1982 Japan .
63-50638 3/1988 Japan .

*Primary Examiner*—Parshotam S. Lall
*Attorney, Agent, or Firm*—Howard N. Conkey

[57] ABSTRACT

The fuel control routine of an engine control module sets a cold enrichment schedule used for engine starting when the engine is cold. The enrichment value is dependent on coolant temperature. To prevent plug fouling in a new vehicle subject to short engine run times, the enrichment value is reduced if the mileage is below 50 miles, the coolant temperature is within set limits and the previous engine run time was shorter than a set period.

6 Claims, 2 Drawing Sheets

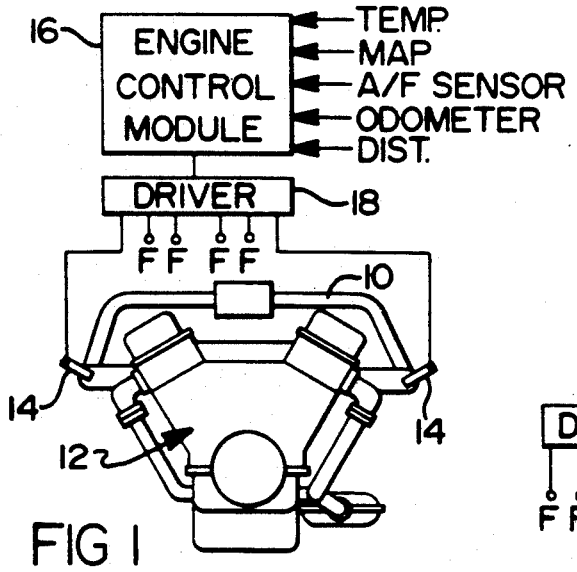
FIG 1
FIG 2
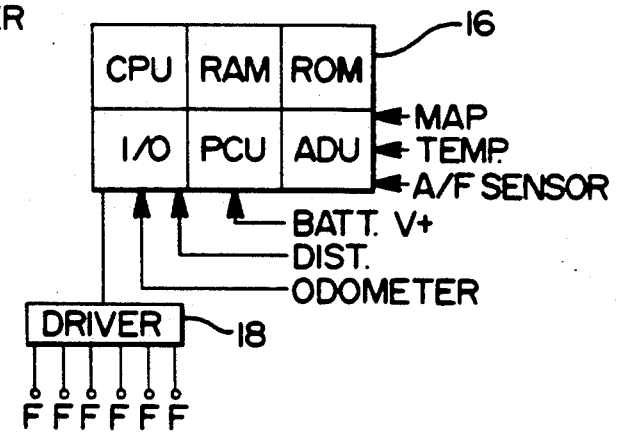
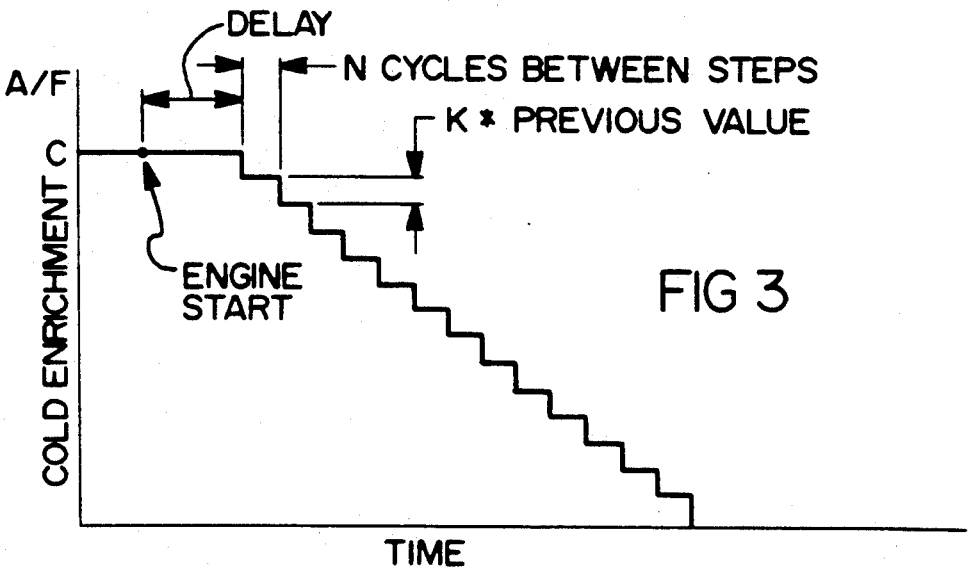
FIG 3
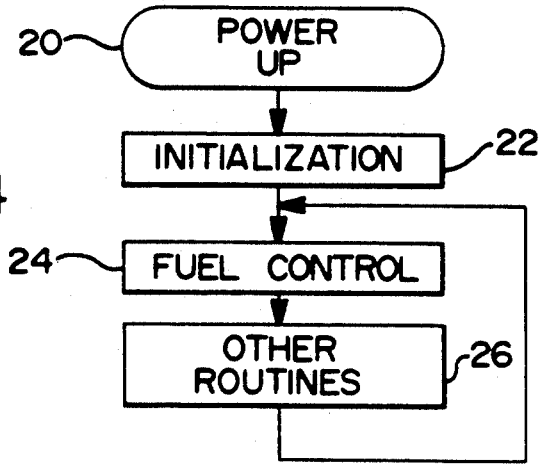
FIG 4

METHOD OF PREVENTING SPARK PLUG FOULING

FIELD OF THE INVENTION

This invention relates to fuel control of an automotive internal combustion engine and particularly to such a fuel control for preventing spark plug fouling in new vehicles.

BACKGROUND OF THE INVENTION

Optimum usage of automotive engines requires that engine run periods be long enough for the engine to become thoroughly heated. Short run periods can result in deposits which remain in the engine because they do not "burn off". An example of this phenomenon is spark plug fouling which occurs when an engine is started with a rich air/fuel mixture. A cold engine requires such a rich mixture for proper starting but a certain amount of the fuel remains in the liquid state and causes a deposit to form on the spark plugs. This is particularly true in the case of port injection engines which, due to the proximity of the injector to the cylinder, afford little time for injected fuel to vaporize. The deposit on the spark plug burns off if the engine runs long enough to get warm, but if the engine is subject to many consecutive short run periods the deposits will accumulate and become permanent; thus spark plug fouling results.

When a new vehicle is produced it is subject to a marshalling period before it is delivered to a customer. The marshalling comprises moving the vehicle short distances in the plant or to a holding area, loading onto a carrier for delivery to a dealer, and then further short moves while in the hands of the dealer. Each short move results in a short engine run period. The overall effect of the marshalling can be spark plug fouling.

SUMMARY OF THE INVENTION

It is therefore an object of the invention to control the engine during the marshalling period in a manner to prevent spark plug fouling.

The invention is carried out by a method of preventing spark plug fouling in an internal combustion engine of an automotive vehicle, wherein the engine has a fuel control system for controlling the air/fuel ratio during engine starting, the method comprising the steps of: measuring engine coolant temperature, selecting a cold enrichment value of air/fuel ratio according to engine coolant temperature, comparing the coolant temperature to preset limits, comparing the vehicle usage to a set value, when the coolant temperature is within the limits and the usage is below the set value, reducing the enrichment value of air/fuel ratio, starting the engine using the reduced enrichment value of air/fuel ratio, and further reducing the air/fuel ratio according to a schedule during engine operation.

BRIEF DESCRIPTION OF THE DRAWINGS

The above and other advantages of the invention will become more apparent from the following description taken in conjunction with the accompanying drawings wherein like references refer to like parts and wherein:

FIG. 1 illustrates an internal combustion engine and fuel control system incorporating the principles of this invention, FIG. 2 is a diagram of the digital engine control module of FIG. 1 responsive to engine and vehicle operating conditions for controlling the air/fuel ratio of the mixture supplied to the engine in accord with the principles of this invention, FIG. 3 is a graphical representation of a cold enrichment schedule employed in the digital engine control of FIG. 1, and FIGS. 4 and 5 are flow diagrams illustrating the operation of the digital engine controller in controlling the air/fuel ratio in accordance with the invention.

DESCRIPTION OF THE INVENTION

Figure 5:
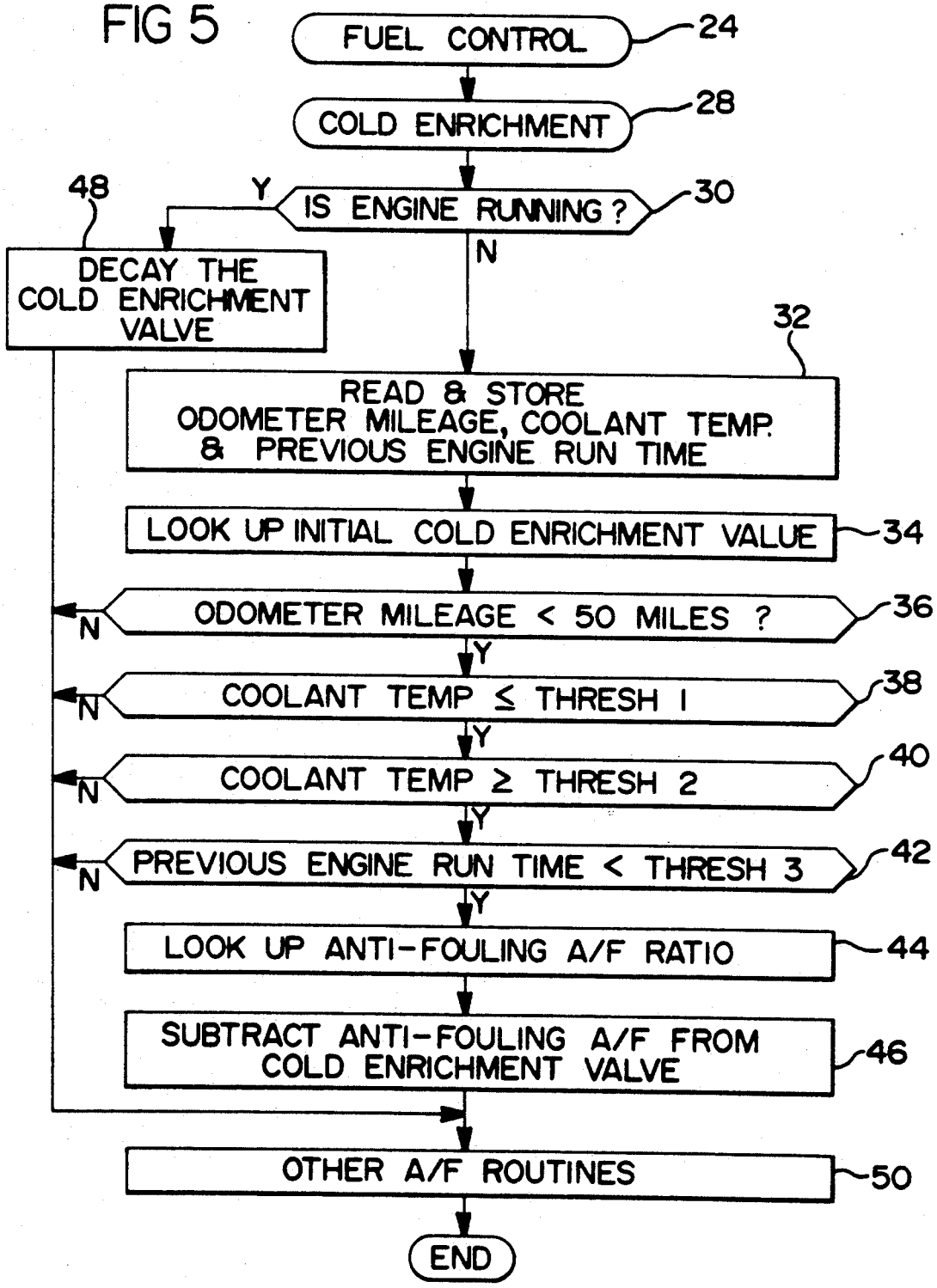

Referring to FIGS. 1 and 2, there is illustrated a digital fuel injection system for metering fuel to the intake manifold 10 of an internal combustion engine 12. For purposes of illustrating this invention it is assumed that the engine 12 is supplied with fuel via a plurality of fuel injectors 14 in the manifold 10 adjacent each cylinder port. When a fuel injector 14 is opened, fuel is admitted at a substantially constant rate from a constant pressure fuel supply, not shown, into the manifold adjacent an engine intake valve where it at least partially vaporizes and mixes with the air drawn into the intake manifold and thereafter into the combustion space of the engine 12. The injector 14 is energized by an engine control module (ECM) 16 for durations in accord with the values of various engine operating parameters to provide a desired ratio of the air-fuel mixture into the engine 12.

As specifically illustrated in FIG. 2, the ECM 16 in the present embodiment takes the form of a digital computer. The digital computer is standard in form and includes a central processing unit (CPU) which executes an operating program permanently stored in a read-only memory (ROM) which also stores tables and constants utilized in determining the fuel requirements of the engine. Contained within the CPU are conventional counters, registers, accumulators, flag flip-flops etc. along with a crystal which provides a high frequency clock signal.

The ECM 16 also includes a random access memory (RAM) into which data may be temporarily stored and from which data may be read at various address locations determined in accord with the program stored in the ROM. A power control unit (PCU) receives battery voltage V+and provides regulated power to the various operation circuits in the ECM 16. The ECM also includes an input/output circuit (I/O) that in turn includes an output counter section. The output counter section is controlled by the CPU to provide timed injection pulses to a driver circuit 18 for energizing the injectors 14. The I/0 receives distributor pulses which are used to calculate engine speed and an odometer input which is used to determine vehicle mileage. Ideally, the vehicle has a body computer which collects odometer data and provides serial odometer data to the I/O.

In addition, the ECM has an analog-to-digital unit (ADU) which provides for the measurement of analog signals. Analog signals representing conditions upon which the injection pulse widths are based are supplied to the ADU. In the present embodiment, those signals include a manifold absolute pressure signal (MAP) provided by a conventional pressure sensor, an engine coolant temperature signal (TEMP) provided by a conventional coolant temperature sensor and an air/fuel ratio signal A/F provided by a conventional oxygen sensor positioned in the exhaust manifold of the engine 12 to monitor the oxidizing/reducing conditions of the exhaust gases. The analog signals are each sampled and converted under control of the CPU. At the end of the conversion cycle, the ADU generates an interrupt after which the digital data is read on command from the CPU and stored in ROM designated memory locations.

When the engine has warmed up the ECM 16 provides for closed loop control of the air/fuel ratio of the mixture supplied to the engine 12 to provide a substantially constant stoichiometric air/fuel ratio. This is accomplished by calculating the required pulse width based on the mass air flow through the engine 12. Prior to engine warm up, a richer mixture is provided for improved performance and easier starting.

A cold enrichment program includes a table calibrated for the particular type of engine which lists the initial air/fuel enrichment for use at the time of engine starting. A typical enrichment table includes 14 levels of enrichment ranging from 5.6 at −40° C. coolant temperature to 0.8 at 116° C. No adjustments are made for higher temperatures. The tabulated enrichment values are added to the stoichiometric air/fuel ratio. Then the enrichment value is decreased or decayed during engine operation according to a schedule which gradually reduces the enrichment to zero.

As shown in FIG. 3, the enrichment decay schedule causes the enrichment factor to reduce stepwise in accordance with the number of engine cycles, where an engine cycle is eight cylinder firings for an eight cylinder engine, for example. The initial cold enrichment value used for engine starting is C. After the engine starts, a delay time must expire before decay of the enrichment value begins. Then the value C is stepped down to a new value determined by multiplying the previous enrichment value by a constant K. Then after each set of N engine cycles another step decrease occurs. The value K is fixed for each engine but the values of N and the delay time vary according to coolant temperature and thus tables are established for them. Examples of the values for a coolant temperature of 8° C. are C=5.2, Delay=17 engine cycles, and N=10 cycles. The value of K is 0.977, for example. As thus far described, the enrichment scheme is well known.

The cold enrichment schedule tends to supply liquid fuel to the cylinder and that may cause a deposit to form on the spark plugs. When the engine warms up, the deposit burns off. In the case of new vehicles which are subject to many short engine operations that do not allow the engine to warm up, the deposits accumulate to cause spark plug fouling. To avoid fouling, the enrichment is reduced if the vehicle has low mileage and the engine is cold. If, however, in the previous operation the engine was run for several minutes, the enrichment is not reduced for the present operation. A schedule of enleanment values as a function of coolant temperature is stored in a lookup table and the appropriate value is selected and subtracted from the initial cold enrichment value for use as the initial value C in the enrichment schedule shown in FIG. 3. The values range, for example, from 4.1 to 0.7 within the temperature range of 0° C. to 80° C. At the 8° C. level the value in the example is 3.9. Thus the cold enrichment value from the table, 5.2, is reduced by 3.9 so that the initial value C=1.3.

The flow charts of FIG. 4 and 5 illustrate the executive program for the ECM 16 and the program for the anti-fouling method, respectively. Numerals in angle brackets <nn> refer to the functions in the block bearing that reference numeral. In FIG. 4, when power is first applied to the system the computer program is initiated <20> and an initialization step is performed <22>. At this step, initial values stored in the ROM are entered into ROM designated locations in the RAM and counters, flags and timers are initialized. At this time the coolant temperature is sampled and stored and the odometer reading is acquired. A fuel control routine is then performed <24> and other routines are performed <26>. Then the loop returns to the fuel control program so that the programs continually repeat at some fixed rate such as every 12.5 msecs.

As shown in FIG. 5, the fuel control routine 24 enters a cold enrichment loop 28. If the engine is not running <30>, the odometer mileage, the coolant temperature, and the previous engine run time are read and stored <32>. Then the initial cold enrichment value is looked up in the table <34> as a function of coolant temperature. Then if the odometer value is less than 50 miles <36>, the coolant temperature is below a first threshold (such as 80° C.) <38>, the coolant temperature is above a second threshold (such as 0° C.) <40>, and the engine run time in the previous ignition cycle is less than a third threshold (such as eight minutes) <42>, then the anti-fouling or enleanment value is looked up in its table as a function of coolant temperature <44> and that value is subtracted from the cold enrichment value found in step 34 <46>; the difference is used as the initial enrichment value C. If any of the odometer, temperature or previous run time requirements are not met, the value found in step 34 is used as the initial cold enrichment value C. If the engine is running <30>, the steps 32 to 46 are bypassed and the decay schedule illustrated in FIG. 3 is applied to the cold enrichment value <48>. Then other air/fuel ratio routines are executed <50> and the program flows to the other routines 26 in the main loop.

It will thus be seen that the problem of spark plug fouling during factory and dealer marshalling is accommodated by a software improvement using standard engine control hardware. By reducing the enrichment under circumstances favorable to plug fouling, less liquid phase fuel is supplied to the cylinder and the build up of deposits on the spark plugs is minimized.

The embodiments of the invention in which an exclusive property or privilege is claimed are defined as follows:

1. A method of preventing spark plug fouling in an internal combustion engine of an automotive vehicle, wherein the engine has a fuel control system for controlling the air/fuel ratio during engine starting, the method comprising the steps of:

measuring engine coolant temperature, selecting a cold enrichment value of air/fuel ratio according to engine coolant temperature, comparing the coolant temperature to preset limits, comparing the vehicle mileage to a threshold value, when the coolant temperature is within the limits and the usage is below the set value, reducing the enrichment value of air/fuel ratio;

starting the engine using the reduced enrichment value of air/fuel ratio, and further reducing the air/fuel ratio according to a schedule during engine operation.

2. The invention as defined in claim 1 wherein the step of reducing the enrichment value comprises selecting a reduction amount from a table on the basis of coolant temperature and subtracting the reduction amount from the selected value.

3. The invention as defined in claim 1 including the step of recording the vehicle mileage, and wherein the step of comparing the vehicle mileage to a set value comprises comparing the recorded mileage to a threshold mileage.

4. The invention as defined in claim 1 including the step of measuring and storing the engine run time for the previous ignition cycle, and wherein the step of reducing the enrichment value is bypassed when the said run time exceeds a threshold.

5. A method of preventing spark plug fouling in an internal combustion engine of an automotive vehicle when the engine is new and subject to short run times, wherein the engine has a fuel control system for controlling the air/fuel ratio during engine starting, the method comprising the steps of:

measuring engine coolant temperature, selecting a cold enrichment value of air/fuel ratio and a reduction value according to engine coolant temperature, comparing the coolant temperature to preset limits, comparing the vehicle mileage to a mileage threshold, comparing the engine run time for the previous cycle to a time threshold, when the coolant temperature is within the limits, the mileage is below the mileage threshold and the said run time is below a time threshold, reducing the enrichment value of air/fuel ratio by the said reduction value, and starting the engine using the reduced enrichment value of air/fuel ratio.

6. The invention as defined in claim 5 including the additional step of:

further reducing the air fuel ratio according to a decay schedule during engine operation.

* * * * *